US006062803A

United States Patent [19]

Christenson

[11] Patent Number: 6,062,803

[45] **Date of Patent: *May 16, 2000**

[54] REPLACEABLE EJECTOR SLIDE TUBES

[75] Inventor: Ronald E. Christenson, Parsons, Tenn.

[73] Assignee: McNeilus Truck and Manufacturing, Inc., Dodge Center, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/383,361

[22] Filed: Feb. 3, 1995

[51] Int. Cl.[7] ..... B30B 15/06

[52] U.S. Cl. ..... 414/513; 414/517; 414/525.2; 384/7; 384/907; 384/912

[58] Field of Search ..... 414/509, 510, 414/511, 512, 513, 514, 515, 516, 517, 525.1, 525.2, 525.3, 525.4, 525.55, 525.6; 104/134, 136; 384/912, 907; 254/7, 93 R

[56] References Cited

U.S. PATENT DOCUMENTS

| | | | |
|---|---|---|---|
| 2,179,726 | 11/1939 | Lewis et al. | 414/513 |
| 2,800,234 | 7/1957 | Herpich et al. | 414/513 |
| 3,486,646 | 12/1969 | O'Brien et al. | 414/513 |
| 3,899,090 | 8/1975 | Telesio | 414/513 |
| 4,877,366 | 10/1989 | De Filippi | 414/517 |

FOREIGN PATENT DOCUMENTS

| | | | |
|---|---|---|---|
| 65249 | 11/1982 | European Pat. Off. | 414/513 |

*Primary Examiner*—Frank E. Werner
*Attorney, Agent, or Firm*—Nikolai, Mersereau & Dietz, P.A.

[57] ABSTRACT

A replaceable load bearing slide system for carrying an ejector mechanism slidably along in spaced parallel ejector rails includes an elongated substantially rectangular slide member for slidably supporting one side of an ejector mechanism in a rail having one side attached along one side of the ejector mechanism at rail level by removable bolts or screws. The elongated member being configured to be slidably accommodated in an ejector rail of matching shape and having optional wear strips attached to the three exposed surfaces thereof designed to contact the inner surfaces of the rail.

15 Claims, 3 Drawing Sheets

REPLACEABLE EJECTOR SLIDE TUBES

BACKGROUND OF THE INVENTION

I. Field of the Invention

The present invention is directed primarily to task-specific truck bodies dedicated to refuse hauling that employ reciprocally operating ejector systems, particularly, those which are supported by a pair of slider bars which ride in spaced, shaped side rails mounted within the truck body. Specifically, the invention focuses on replaceable slider tubes or bars for use in conjunction with the operation of ejection and/or packing mechanisms on such vehicles.

II. Related Art

Refuse hauling trucks commonly include a heavy-duty chassis and a hollow truck body mounted on the chassis and dedicated to receiving, compacting and discharging refuse materials. The combination includes all the associated hydraulic, pneumatic and/or electric operating mechanisms associated with heavy-duty packing and ejection equipment. Such trucks are typically loaded from the rear, front or side and have a heavy hydraulic-operated compacting systems to compact the refuse in the forward direction against an ejector blade in the case of the rear loading trucks and rearward of a reciprocating ejector system in the case of front loading trucks.

Specifically, front loaders include a refuse hauling reservoir designed for loading by dumping containers over the cab from the front of the vehicle; compaction is rearward and discharge is from the rear of the vehicle. A cylinder-operated compaction/ejection mechanism moves the wall aft along a horizontal plane in the manner of a plow blade to pack and compress the refuse in the refuse reservoir after each loading. Between loadings, the packer blade is moved forward to allow more refuse to enter the reservoir behind the blade. In this manner, refuse is eventually packed against a heavy-duty tailgate until the refuse reservoir is full at which point it must be emptied. The tailgate or container discharge closure mechanism at the rear of the truck body reservoir is opened (raised) and the ejector blade is moved fully aft by full extension of the operating cylinder or cylinders to expel the entire contents of the refuse reservoir.

In rear loading vehicles, the ejector blade conventionally forms the lower part of the front wall of the refuse reservoir and large hydraulic packers push the loaded refuse forward against the blade until the reservoir is fully packed. The rear loader discharges by fully raising the tailgate and operating the ejector blade rearward to, as in the case of the front loader, eject the entire contents from the rear of the open reservoir.

It will be appreciated that both rear loading and front loading refuse trucks, then, typically employ reciprocating ejector systems which traverse fore and aft within the hollow refuse reservoir. These devices typically ride in spaced parallel ejector rails configured to accept elongated load bearing slider tubes or bars attached to and extending along the parallel sides of the ejector. In this manner, the rails in conjunction with the load bearing slider tubes or bars carry the ejector system just above the truck body floor. The load bearing sliders attached to the ejector mechanism generally ride in recesses configured in the rails concentrate a large force on a relatively small area and it has been found that the slider tubes or bars wear at a fairly rapid rate, especially the forward and aft sections thereof. Of course, it is expensive and undesirable to require the replacement of an entire ejector system or to require extensive repairs on an ejector system which is otherwise intact because of the relatively rapid wear of certain areas of the slider bars. Slider bars that are easily replaced or refurbished would greatly reduce the cost of extending the life of ejector systems of the class and would be a highly desirable improvement.

Accordingly, it is a primary object of the invention to provide ejector slide tubes or bars that are readily removable and replaceable when worn.

Another object of the invention is to provide readily removable slide tubes or bars having replaceable wear strips or surfaces.

A still further object of the invention is to provide a lightweight tubular slide bar having attached replaceable wear surfaces for a sliding ejector system.

Other objects and advantages will occur to those skilled in the art upon becoming familiar with the specification and claims contained herein.

SUMMARY OF THE INVENTION

By means of the present invention, problems associated with rapid excessive slide tube or slide bar wear in reciprocally operating rail-mounted ejector systems are overcome by the provision of a replaceable or reparable slide tube or bar which can be readily removed and re-attached or detached from the ejector body. The replaceable wear bar is removably attached to a side flange on the ejector structure as by machine screws or bolts rather than being welded to the ejector structure so that the entire bar is readily removable. The slide tube or bar of the invention itself may take any of several forms. These include the form of an elongated hollow tubular member with or without separate replaceable outer wear strips. Outer wear strips may be provided of tempered or harder steel than the tube or bar to provide additional wear resistance. The slide bar can be made as a solid section of material also; however, this adds additional weight to the system.

In addition to providing ease of removal and replacement, the use of a plurality of screws, for example, to attach the slide tubes or bars to the ejector allows for an amount of give or adjustment in the system not found utilizing traditional welded joints which may experience stress cracking. Embodiments having attached wear strips can be renewed by removal of the slide tubes or bars and replacement of the worn wear strips done.

BRIEF DESCRIPTION OF THE DRAWINGS

In the drawings, wherein like numerals are utilized to designate like parts throughout the same.

DETAILED DESCRIPTION

The present invention represents improvements in the durability of refuse truck ejector mechanisms and improvements that reduce associated maintenance costs. The present invention is directed to a removable/replaceable or reparable tube type or solid slide bar configuration for such an ejector system which can be readily removed from the ejector itself and repaired as by renewing wear surfaces or replaced by just the removal of several hex bolts, screws or the like attaching the slide tube or bar to the ejector.

Figure 1:
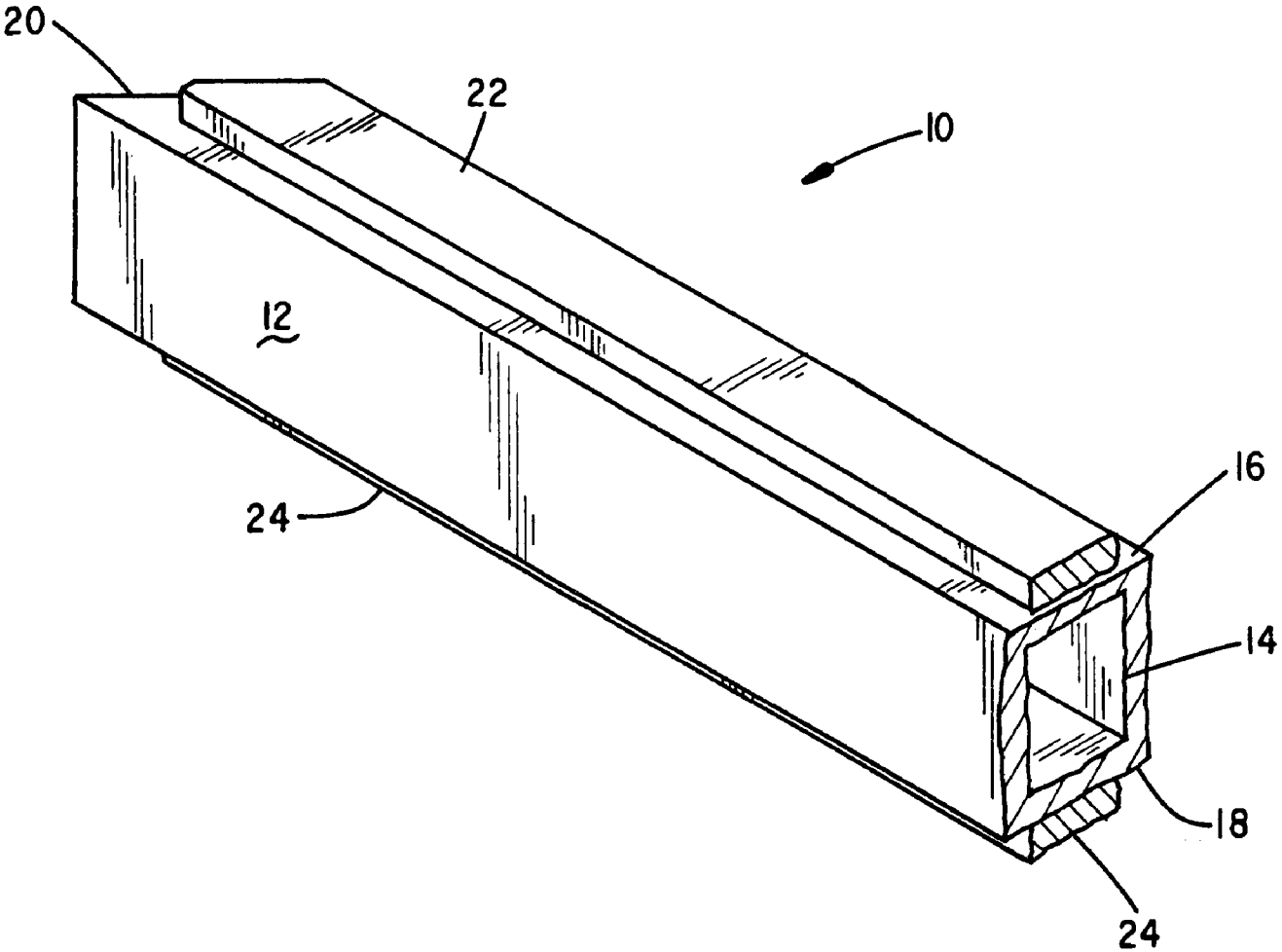
FIG. 1 is a fragmentary side perspective view of one embodiment of the removable slider bar of the present invention.

As depicted in FIG. 1, the rider member (bar or tube), generally at 10, has a generally rectangular configuration with parallel sides 12 and 14 (FIG. 2), top 16 and bottom 18. The end of the slide tube is shown as an outward beveled configuration at 20 which aids in preventing build up of refuse material within the track traversed by the rider bar 10. The rider tube is provided with a plurality of wear plates or strips 22, 24 and 26 on the three sides which provide wear surfaces to contact the support rail.

Figure 2:
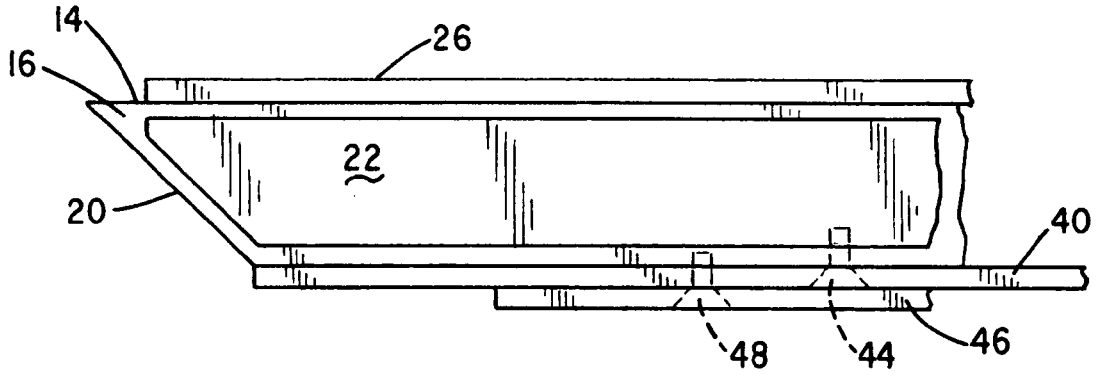
FIG. 2 is a fragmentary top view of the slider bar of FIG. 1 shown attached to an ejector panel plate with a cover plate.
Figure 3:
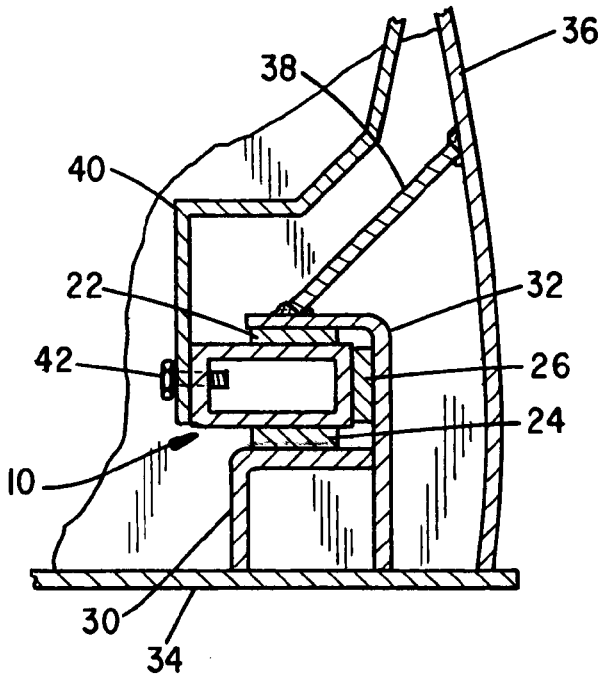
FIG. 3 is a fragmentary cross-sectional view showing the slider bar of FIG. 1 mounted within the track of the ejector of a refuse vehicle.
Figure 4:
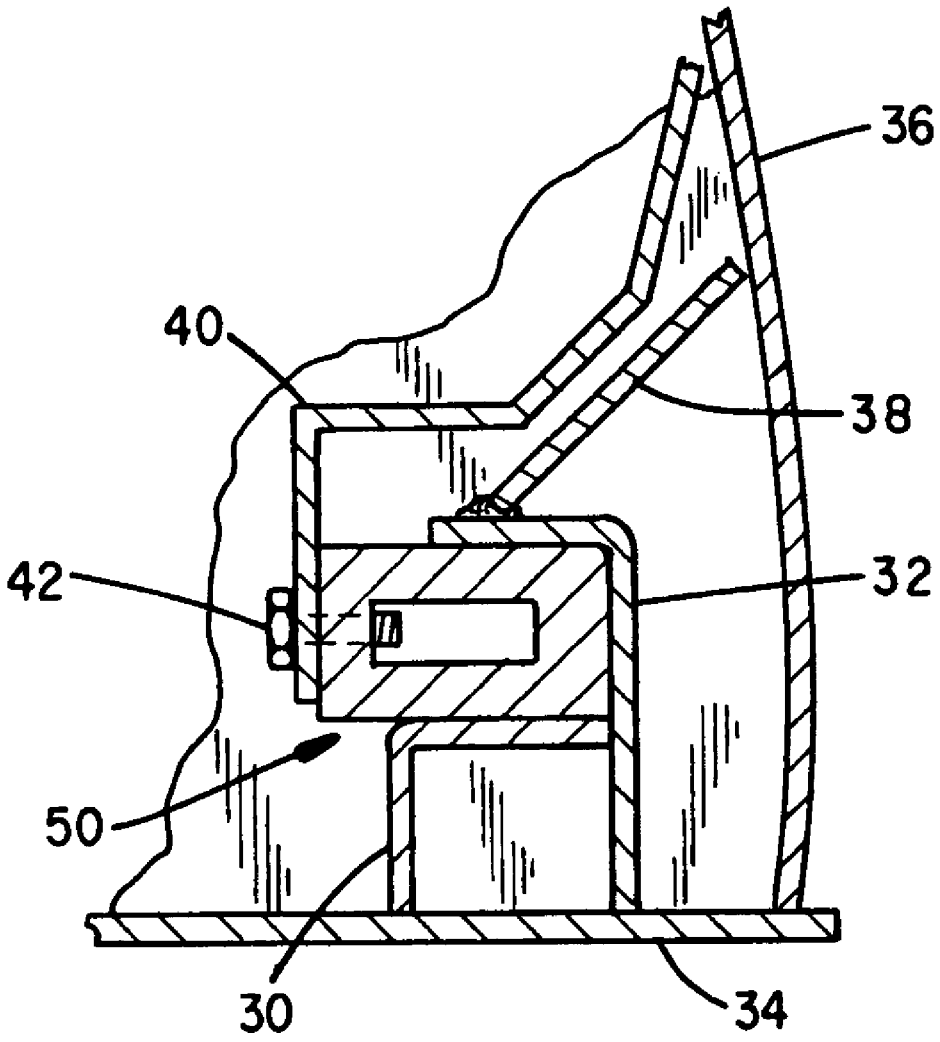
FIG. 4 is a fragmentary cross-sectional view similar to that of FIG. 3 showing an alternate embodiment of the slide bar of the invention.

As best seen in the fragmentary cross-sectional view of FIG. 3, the rail system consists of a pair of structural angle shapes 30 and 32 which combine to produce a rigid open rail structure secured to the truck floor 34 and the side wall 36 utilizing additional brace or strut plate member 38. A portion of the ejector structure including a side panel or plate 40 to which the slide tube or bar 10 is bolted at 42. In this manner, the track member 32 forms the side and upper portion of the enclosed track and the member 30 the lower surface. FIG. 4 is substantially the same view as FIG. 3 except that the wear tube 50 is not provided with the external wear bars 22, 24 and 26. The slide member may be bolted to the ejector plate member 40 as by hex bolts 42 or by using countersunk machine screws as at 44 (FIG. 2). In addition, a protective cover plate 46 may be attached as with screws 48. This provides an optional screw retention device if desired.

It will be noted that the slide tubes or bars may be made out of a variety of materials but are preferably steel and, in the case of the embodiment of FIGS. 1–3, the tube member itself is normally made from mild steel plate and the wear bars or strips 22, 24 and 26 made from tempered or case hardened steel to reduce the wear still further. With respect to the eternal wear bars 22, 24 and 26, these are typically welded at spaced locations about the periphery to the tube member. In this manner, worn wear bars may be readily removed with a cutting torch and replaced by welding new ones in place.

The illustrations of FIGS. 3 and 4 depict the wear tubes 10 as being hollow tubes connected by hex-head bolts 42 threaded into capped openings in the tube. Of course, these may be replaced by the countersunk screws shown at 44 in FIG. 2. In addition, hollow slide tubes may be provided with threaded inserts or internal threaded (tapped) blocks at the locations of the attaching screws, if desired.

It will further be noted that although the combination of mild steel and hardened or tempered steel for the tubes and wear stirps are preferred, other materials including metal alloys such as brass and high-impact, wear-resistant polymer materials are also contemplated for such use.

This invention has been described herein in considerable detail in order to comply with the Patent Statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

I claim:

1. An ejector mechanism for a rear discharging refuse collection vehicle including a storage body having sides and a floor and a hydraulic operating system, said ejector mechanism including an ejector blade, said ejector blade being designed to linearly reciprocate along said storage body as operated by said hydraulic system to discharge refuse from the rear of said storage body, said ejector mechanism further being supported by a pair of slide systems carried in a pair of spaced parallel ejector rails formed by elongated shaped members mounted along the sides of said storage body, said slide systems comprising a pair of replaceable slide members, one fixed to each side of said ejector mechanism by threaded attaching devices, each having a longitudinal axis that is substantially perpendicular to the side of the storage body and being located away from said ejector rails so as to be accessible regardless of the location of said ejector mechanism along said rails such that only removal of the threaded attaching devices is necessary to enable direct removal of each entire slide member for replacement.

2. An ejector mechanism for a rear discharging refuse truck having a hollow storage body including sidewalls and a floor comprising:

(a) a pair of spaced parallel hollow ejector rails formed by elongated shaped members mounted in and lengthwise of said storage body and fixed thereto;

(b) an ejector mechanism having a blade and designed to be carried along and supported by said pair of spaced parallel ejector rails;

(c) a pair of slide members for supporting said ejector mechanism on said ejector rails, one attached to each side of said ejector mechanism, said slide members having outer surfaces for contacting said ejector rails;

(d) an ejector operating mechanism for reciprocally operating said ejector mechanism in said storage body; and (e) externally accessible removable threaded attached devices, each having a longitudinal axis that is substantially perpendicular to the sidewalls of the storage body and being located away from said ejector rails so as to be accessible regardless of the location of said ejector mechanism along said rails, said slide members being attached in a manner such that only removal of said attaching devices is necessary to enable each entire slide member to be readily removed for replacement.

3. The apparatus of claim 2 wherein said threaded attaching devices are selected from the group consisting of screws and bolts.

4. The apparatus of claim 3 wherein said attaching devices are machine screws.

5. The slide system of claim 4 further comprising an over plate attached by removable threaded screws to each side of said ejector to prevent backout of said machine screws.

6. The slide system of claim 2 including wear strips attached to the outer surfaces of said slide members.

7. The slide system of claim 6 wherein the slide member is mild steel and the wear strips are tempered steel.

8. The apparatus of claim 2 wherein the slide member is of a hollow tubular form.

9. The slide system of claim 8 further comprising outwardly beveled ends on said slide member for reducing buildup of material in the rails.

10. The slide system of claim 9 including wear strips attached to the exposed surfaces of said slide thereof.

11. The slide system of claim 10 wherein the slide member is mild steel and the wear strips are tempered steel.

12. The slide system of claim 10 wherein said wear strips are selected from the group consisting of metal bars, metal alloy bars and high impact plastics.

13. The slide system of claim 10 wherein said wear strips are of a greater surface hardness than said slide members.

14. The slide system of claim 2 further comprising an over plate attached by removable threaded attaching devices to each side of said ejector to prevent backout of said attaching devices.

15. In a rear discharge refuse vehicle having a rear discharging storage body including walls and a floor, a pair of spaced parallel ejector rails formed by structural members longitudinally mounted in said storage body and fixed to the walls and floor, a linearly reciprocating hydraulically operated packing and ejecting mechanism wherein said packing and ejecting mechanism is carried by a pair of spaced load bearing slide tube systems mounted to reciprocate along in said pair of spaced ejector rails, each of said slide tube systems further comprising:

(a) an elongated, substantially rectangular hollow tubular wear member for slidably supporting one side of said ejector mechanism in one of said ejector rails, said wear member being attached along one side of the ejector mechanism at rail level, said wear member further being configured of matching shape to be slidably accommodated in said one of said ejector rails having exposed outer wear surfaces designed to contact corresponding surfaces of said one of said ejector rails; and (b) removable threaded attaching devices, each having a longitudinal axis that is substantially perpendicular to the sidewalls of the storage body and being located away from said one of said ejector rails so as to be accessible regardless of the location of said ejector mechanism along said rails, said attaching devices attaching said tubular wear member to said ejector mechanism in a manner such that only removal of the threaded attaching devices is necessary to allow said tubular wear members to be readily removed and replaced.

* * * * *